United States Patent [19]

Sande

[11] 4,300,739

[45] Nov. 17, 1981

[54] ADJUSTABLE POLE-MOUNTED MAIL BOX SUPPORT

[76] Inventor: Lloyd P. Sande, West Star Rte., Two Harbors, Minn. 55616

[21] Appl. No.: 140,129

[22] Filed: Apr. 14, 1980

[51] Int. Cl.[3] ..... E04G 3/00

[52] U.S. Cl. ..... 248/219.4; 248/146

[58] Field of Search ..... 211/71, 107; 248/146, 248/149, 145, 230, 219.4; 232/39; 52/40; 403/362, 347, 188

[56] References Cited

U.S. PATENT DOCUMENTS

| | | | |
|---|---|---|---|
| 710,557 | 10/1902 | Bates | 403/347 |
| 1,435,379 | 11/1922 | Connery | 248/145 |
| 2,963,168 | 12/1960 | Wilson | 248/230 X |
| 3,279,732 | 10/1966 | Paul | 248/146 |
| 3,465,994 | 9/1969 | Block | 248/131 X |
| 3,870,262 | 3/1975 | Manning | 232/39 X |

FOREIGN PATENT DOCUMENTS

| | | | |
|---|---|---|---|
| 1208113 | 12/1965 | Fed. Rep. of Germany | 248/230 |

*Primary Examiner*—J. Franklin Foss
*Attorney, Agent, or Firm*—Wicks & Nemer

[57] ABSTRACT

An adjustable pole-mounted mail box support including an elongated frame with a collar adjustably connectable at selected positions on the length of the frame. The collar is adjustably positioned on a pole for vertical adjustment on the pole and for adjustment in a horizontal plane 360° about the pole. The frame carries apparatus for securing a mailbox to the frame for adjusted positions thereon.

1 Claim, 4 Drawing Figures

ADJUSTABLE POLE-MOUNTED MAIL BOX SUPPORT

SUMMARY

The invention relates broadly to an improvement in mail boxes and more particularly to a support for a residential and/or rural type conventional mailbox on a pole.

In mounting a conventional mailbox on a support such as a pole anchored in the ground in a vertical position, there is generally a requirement relative to the positioning of the box with regard to various terrain, access to a driver of a mail truck and in northern climes a buildup of snow and ice.

It is, therefore, an object of the invention to provide a support for a mailbox which may be adjusted to various heights on a vertically disposed pole and in a horizontal plane 360° about a vertical pole to accommodate terrain, access to the mailbox and snow buildups. It is an additional object to provide a support for a mailbox which also allows the mailbox to be adjustably positioned horizontally relative to the support and the pole on which the support is mounted.

The invention will appear more clearly from the following detailed description when taken in connection with the accompanying drawings, showing by way of example a preferred embodiment of the inventive idea wherein like numerals refer to like parts throughout.

In the drawings forming part of this application:

Figures 1, 2, 3, 4:
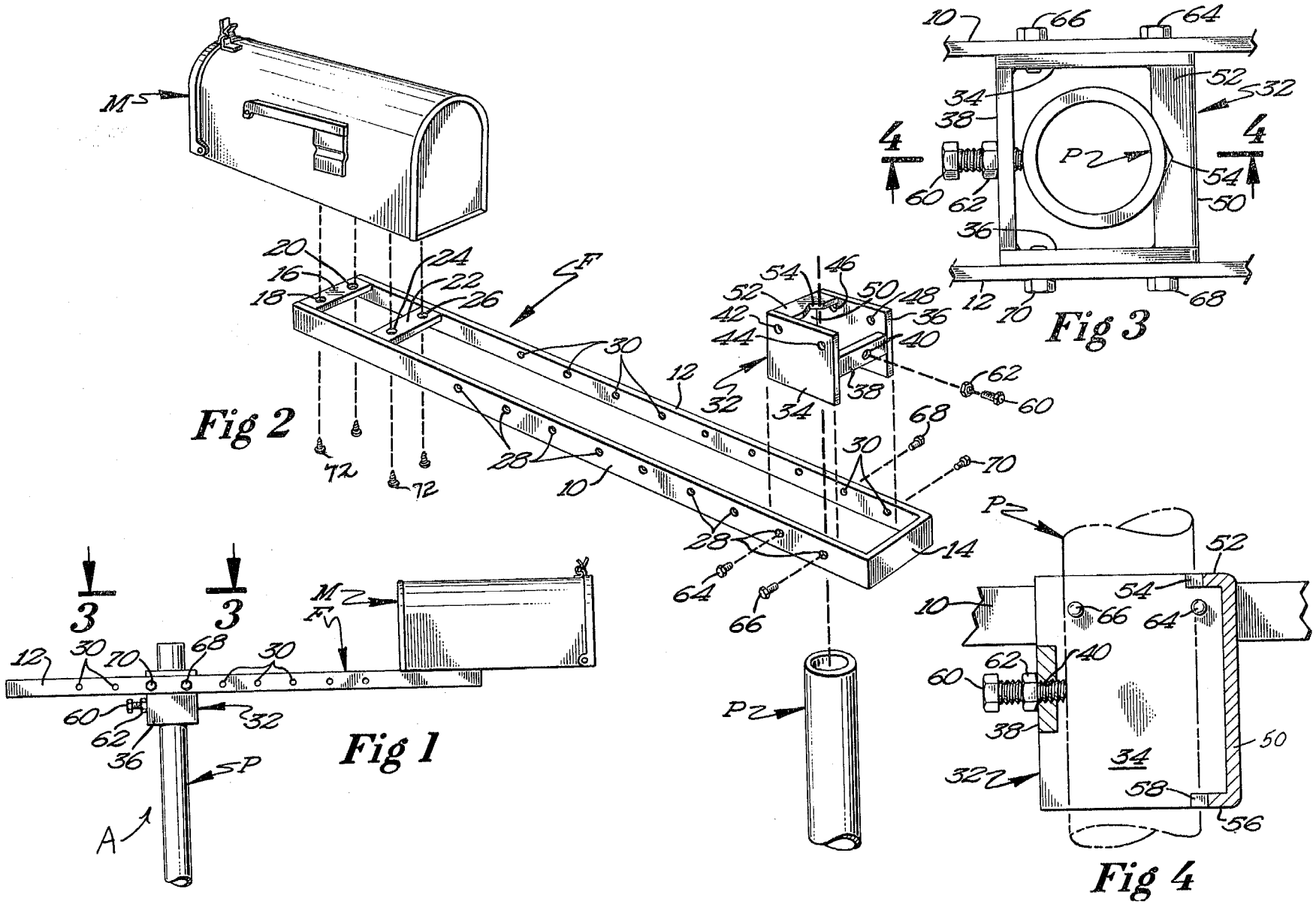
FIG. 1 is a side elevational view of an adjustable pole mounted mail box support embodying the invention.
FIG. 2 is an exploded perspective view of the support.
FIG. 3 is a view on the line 3—3 of FIG. 1.
FIG. 4 is a sectional view on the line 4—4 of FIG. 3.

Referring to the drawings in detail, the mail box support A includes first and second spaced elongated side support members 10 and 12, respectively connected at one end by the end cross bar 14 and at the other end by the flat cross bar 16 formed with the spaced holes 18 and 20. A further flat cross bar 22 is provided at the end area of the bar 16 and it has the spaced holes 24 and 26. The side member 10 is formed with a series of spaced holes 28, and the side member 12 is formed with a series of spaced holes 30. The side members 10 and 12 together with the cross bar 14 and the flat cross bar 16 constitute a frame F.

The numeral 32 designates the rectangular collar which includes first and second side walls 34 and 36, respectively, connected at one edge by the cross bar 38 having the threaded hole 40. The side wall 34 has formed therein the spaced threaded holes 42 and 44, and the sidewall 36 has the spaced threaded holes 46 and 48.

The collar 32 also includes the front wall 50 connected to the sidewalls 34 and 36, and formed at the top edge of the front wall is the top plate 52 at a right angle to the front wall and connected to the sidewalls 34 and 36. The top plate 52 is formed with the V-cut 54. Further provided is a bottom plate formed at the bottom edge of the front wall at a right angle thereto and in alignment with the top plate. The bottom plate 56 is also formed with a V-cut 58 identical to the V-cut 54 and in alignment therewith.

The numeral 60 designates a bolt engageable in the threaded hole 40 and provided with the lock nut 62, the bolt engageable with the post P.

The distance between a pair of holes 28 in the support member 10 is the same as the distance between a pair of holes 42 and 44 in the collar 32 and similarly the distance between a pair of holes 30 in the support 12 is the same as the distance between a pair of holes 46 and 48 of the collar 32. The frame F is adjustably mounted on the collar 32 by means of bolts 64 and 66 inserted through a pair of holes 28 and threadedly engaged in a pair of threaded holes 42 and 44. Similarly, bolts 68 and 70 are inserted through a pair of holes 30 and threadedly engaged in a pair of holes 46 and 48 thereby mounting the side support members on the collar. It will be noted that the side members may be mounted to extend more or less from the collar by using different pairs of holes in the side members depending on the requirement of location of the mailbox M secured to the top of the side members 10 and 12. The box M is secured to the top of the side members 10 and 12 by means of the screws 72 secured through the holes 18, 20, 24 and 26 of the bars 16 and 22, respectively, and into the bottom of the box M.

The frame F may be adjusted vertically on the post P by positioning the post between the cross bar 38 and the front wall 50 in the V-cut 54 and V-cut 58 whereby the pole is aligned and secured with the tightening bolt 60. With the frame F at the desired height on the pole the bolt 60 is tightened to cause the inner end to tightly engage the pole and force the pole into the V-cuts 54 and 58. The frame F may also be adjustably rotated 360° about the axis of the pole to any desired position and then secured by tightening the bolt 60.

Having thus described the invention, what is claimed as new and desired to be secured by Letters Patent is:

1. An adjustable pole-mounted mail box support comprising:

(a) an elongated support frame, including first and second spaced side members each having a series of spaced holes, (b) a collar, having first and second spaced sidewalls connected to a cross bar and front wall, (c) securing means for engagement through the holes of said side frame members and said collar for adjustably connecting said side frame members at selectable positions on said collar, (d) means for adjustably positioning said collar on a pole to place said frame at various positions on a pole including a bolt carried by said cross bar for pressure engagement with said pole and, (e) means for securing a mail box on said support frame.

* * * * *